US005082585A

United States Patent [19]

Hessel et al.

[11] Patent Number: 5,082,585

[45] Date of Patent: * Jan. 21, 1992

[54] ENZYMATIC LIQUID DETERGENT COMPOSITIONS CONTAINING NONIONIC COPOLYMERIC STABILIZING AGENTS FOR INCLUDED LIPOLYTIC ENZYMES

[75] Inventors: John F. Hessel, Metuchen; Martin S. Cardinali, Millington, both of N.J.; Michael P. Aronson, West Nyack, N.Y.

[73] Assignee: Lever Brothers Company, Division of Conopco, Inc., New York, N.Y.

[ * ] Notice: The portion of the term of this patent subsequent to Mar. 13, 2007 has been disclaimed.

[21] Appl. No.: 472,685

[22] Filed: Jan. 31, 1990

Related U.S. Application Data

[63] Continuation-in-part of Ser. No. 305,878, Feb. 2, 1989, Pat. No. 4,908,150.

[51] Int. Cl.[5] ..... C11D 3/37; C11D 3/386

[52] U.S. Cl. ..... 252/174.12; 252/174.23; 252/174.24; 252/DIG. 2; 252/DIG. 12; 252/DIG. 14

[58] Field of Search ..... 252/174.12, 174.23, 252/174.24, DIG. 2, DIG. 12, DIG. 14

[56] References Cited

U.S. PATENT DOCUMENTS

| | | | |
|---|---|---|---|
| 3,944,470 | 3/1976 | Diehl | 435/188 |
| 3,950,277 | 4/1976 | Stewart | 252/541 |
| 4,011,169 | 3/1977 | Diehl | 252/174 |
| 4,142,999 | 3/1979 | Bloching et al. | 252/544 |
| 4,597,898 | 7/1986 | Vander Meer | 252/529 |
| 4,661,287 | 4/1987 | Crossin | 252/542 |
| 4,711,739 | 12/1987 | Kandathil | 252/139 |
| 4,715,990 | 12/1987 | Crossin | 252/551 |
| 4,746,456 | 5/1988 | Kud et al. | 252/174.24 |
| 4,751,008 | 6/1988 | Crossin | 252/8.8 |
| 4,846,994 | 7/1989 | Kud et al. | 252/174.21 |
| 4,846,995 | 7/1989 | Kud et al. | 252/174.21 |
| 4,849,126 | 7/1989 | Kud et al. | 252/174.23 |
| 4,908,150 | 3/1990 | Hessel et al. | 252/174.12 |

FOREIGN PATENT DOCUMENTS

| | | |
|---|---|---|
| 0199403 | 10/1986 | European Pat. Off. . |
| 2633601 | 2/1978 | Fed. Rep. of Germany . |
| 2137652 | 10/1984 | United Kingdom . |

OTHER PUBLICATIONS

European Search Report EP 90-30-0931, 3/21/1991.

*Primary Examiner*—Paul Lieberman
*Assistant Examiner*—A. Beadles-Hay
*Attorney, Agent, or Firm*—James J. Farrell

[57] ABSTRACT

The present invention relates to enzymatic liquid detergent compositons comprising lipolytic enzymes. The stability of the lipolytic enzymes is significantly improved therein by inclusion of particular nonionic ethylene glycol containing copolymers therein. These polymers comprise ethylene oxide or ethylene glycol, copolymerized with difunctional acids or vinylic based copolymers. The liquids are obtained without the aid of hydrocarbon solvents.

7 Claims, No Drawings

ENZYMATIC LIQUID DETERGENT COMPOSITIONS CONTAINING NONIONIC COPOLYMERIC STABILIZING AGENTS FOR INCLUDED LIPOLYTIC ENZYMES

This is a continuation-in-part of U.S. Pat. Application Ser. No. 305,878, filed Feb. 2, 1989, now U.S. Pat. No. 4,908,151.

BACKGROUND OF THE INVENTION

1. Field of the Invention

The present invention relates to enzymatic liquid detergent compositions comprising lipolytic enzymes and a nonionic polymeric stabilizing agent for the lipolytic enzymes.

2. Description of the Related Art

Enzymatic liquid detergent compositions are well-known in the art. Most of the prior proposals are, however, concerned with enzymatic liquid detergent compositions which contain a proteolytic enzyme ingredient, or a mixture thereof with amylolytic enzymes.

One of the problems, inherent to the use of enzymes in liquid detergent compositions is their stability in such liquid detergent compositions. The art is crowded with a variety of proposals to improve the stability of enzymes, particularly proteolytic and/or amylolytic enzymes in liquid detergent compositions.

In U.S. Pat. 4,715,990 (Crossin), enzymatic liquid detergent compositions are described which comprise a proteolytic and/or an amylolytic enzyme and a salt of a lower carboxylic acid such as sodium formate as stabilizer for these enzymes. The compositions furthermore comprise a soil-release promoting polymer which is a water-soluble or water-dispersible polymer of polyethylene terephthalate or polyoxyethylene terephthalate.

Lipolytic enzymes have also been proposed for inclusion in liquid detergent compositions, although to a much lesser extent than proteases and/or amylases.

In U.S. Pat. No. 3,950,277 (Stewart et al.), lipolytic enzymes are described in a pre-soaking composition for fabrics, whereby the pre-soaking composition also contains a lipase activator which can be a polyoxyethylene derivative of ethylenediamine.

In U.S. Pat. No. 3,944,470 (Diehl et al.) and U.S. Pat. No. 4,011,169 (Diehl et al.) certain aminated polysaccharides are proposed as enzyme-stabilizing agent, i.e. for lipolytic enzymes.

In U.S. Pat. No. 4,272,396 (Fukano et al.), enzymatic detergent compositions which may comprise lipase are described, which compositions also contain certain polyethyleneglycols as foam control agents.

In U.S. Pat. No. 4,711,739 (Kandathil), water-in-oil emulsion-type pre-spotter laundry compositions are described which may contain lipolytic enzymes and certain water-insoluble polyester or polyether polyols as enzyme stabilization agents. These compositions also contain a substantial amount of hydrocarbon solvents.

It is an object of the present invention to stabilize lipolytic enzymes with particular nonionic polymers in liquid detergent compositions.

It is another object of the present invention to stabilize mixtures of lipolytic and proteolytic enzymes with particular nonionic polymers in liquid detergent compositions.

A final objective of this invention is liquid detergent compositions containing a stable lipase, alone or in combination with protease, and containing the particular nonionic polymers dissolved or dispersed therein without the aid of hydrocarbon solvents.

SUMMARY OF THE INVENTION

It has now been found that the above objectives can be achieved to a significant extent by the use of particular nonionic polymers composed of ethylene glycol or ethylene oxide copolymerized with certain types of hydrophobic monomers. These hydrophobic monomers are difunctional carboxylic based monomers such as adipic acid or hydrophobic vinyl monomers, such as vinyl acetate. The polymers preferably have a cloud point below 80° C. at 1% in aqueous solution. In contrast to the polymers disclosed in U.S. Pat. No. 4,711,739, which must be water-insoluble and possess an acid number below 1.0 mg to be useful in water-in-oil emulsions containing substantial hydrocarbon solvent, some of the present polymers may dissolve in the compositions without the aid of a hydrocarbon solvent and can have an acid number well in excess of 1.0 mg. Solubility in isotropic heavy duty liquids (HDLs) is not required. These polymers appear to be functional enzyme stabilizers even when they are not fully compatible in isotropic HDLs, for example, PEG/methyl methacrylates. These polymers may be expected to be useful as enzyme stabilizers in other product forms such as emulsion prespotters and structured liquids. In fact, some of the most effective polymers have acid numbers as high as 3.3 mg.

DETAILED DESCRIPTION OF THE INVENTION

The nonionic polymer of the invention is comprised of ethylene glycol or ethylene oxide copolymerized with one or more hydrophobic type comonomers. Preferred copolymers are polyesters of ethylene glycol with a hydrophobic comonomer such as adipic acid, terephthalic acid and the like, and copolymers of ethylene oxide with vinylacetate. The copolymers can be of the predominantly linear block or random type or can also be graft copolymers with pendant side chains. The average molecular weight ranges from about 3,000 to about 1,000,000. These copolymers are known per se e.g. from U.S. Pat. No. 4,715,990; U.S. Pat. No. 3,959,230 and European Patent 219,048 which describe suitable examples. The polymers are soluble or dispersible in the final liquid composition.

One particularly suitable class of polymers are copolymers of alkyl, aryl, or alkylaryl dicarboxylic acids with ethylene glycol or ethylene oxide. These include: adipic acid, sebacic acid, dodecanedioic acid, terephthalic acid and the like. A few examples of polymers within this general class are:

i) Hoechst PE/88/2W—copolymer of adipic acid and ethylene glycol substituted with alkyl amine having the following structure:

$$-[OC(CH_2)_4CO]_y-[OCH_2CH_2]_x-\underset{\underset{R}{|}}{N}-[CH_2CH_2O]_z-$$

where $R = C_{16}$–$C_{18}$ hydrocarbon, where y is about 1 to about 500 and preferably about 10; where the sum of $x+z$ is about 40 to 14,000 and preferably about 300 and where the value of the fraction:

$$\frac{x+z}{y}$$

is about 2 to about 100 and preferably about 2. This specific polymer preferably has a molecular weight of about 22,000. The values of x, y and z are selected to insure that the polymer is soluble or dispersible in the liquid composition of the invention.

ii) Alkaril OCJ—copolymer of ethylene glycol and terephthalic acid having the following structure:

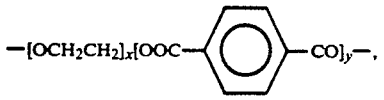

where x is about 30 to about 11,000 and preferably about 220; where y is about 1 to about 500 and preferably 10; where the value of the fraction x/y is about 5 to about 100 and preferably about 22. The molecular weight of this example of polymer is preferably about 20,000. As in the example above the values of x and y are selected to insure that the polymer is soluble or dispersible in the final liquid detergent composition.

A second class of polymers found to be effective is polymers of ethylene glycol or ethylene oxide copolymerized with vinylic monomers such as vinyl esters, for example, vinyl acetate, methyl methacrylate, butyl acrylate, and the like. Vinylic monomers such as styrene and acrylamide and mixtures thereof and the like are also appropriate. An example of these types of polymers is Copolymer HP 22 sold by BASF. Its structure is:

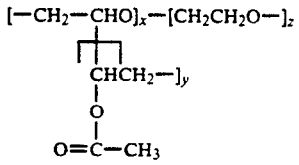

where y has a value of about 25 to about 9,000 preferably about 50; where the sum of x + z is about 15 to about 6,000 and preferably about 400 and where the value of the fraction $$\frac{x+z}{y}$$

is about 0.1 to about 10 and preferably about 7. The preferred molecular weight of this polymer is about 24,000. As above the values of x, y and z are selected to insure the polymer is soluble or dispersible in the final liquid composition.

It is understood that these monomers can be appropriately substituted to alter their solubility as desired. Also, other comonomers such as propylene oxide or butylene oxide can be employed in small amounts.

Thus, the ethylene glycol or ethylene oxide containing polymers useful in the present invention can be represented by the following general structure:

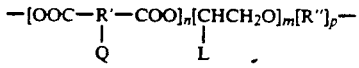

where R′ is a saturated, unsaturated, or aromatic hydrocarbon of 2–18 carbon atoms, preferably 4–12, R″ is selected from the group: propylene glycol, butylene glycol, an extended ethoxylate such as a multifunctional fatty amine ethoxylate, polyethylene glycol ether of glycerol esters or fatty ethanolamides and the like, Q an L are independently selected from the group consisting of:

i) hydrogen, alkyl, alkylaryl, alkoxy, and alkylamine groups containing 1 to 20 carbon atoms, and
ii) hydrophobic vinylic based grafts such as, for example, vinyl acetate, methyl methacrylate, butyl acrylate, styrene and the like.

m must have a value at least one and preferably greater than five and n and p can be any integer including zero, the latter only when L is not hydrogen. However, the sum of m, n, and p are chosen such that the resulting polymer has a cloud point below 80° C. but is soluble or dispersible in the final liquid detergent composition.

In general, the nonionic polymer is incorporated in the compositions of the invention in an amount of about 0.1 to about 10% by weight, preferably from about 0.25% to about 2% by weight.

The lipolytic enzyme used in the present invention is either a fungal lipase producible by *Humicola lanuginosa* and *Thermomyces lanuginosus*, or a bacterial lipase which shows a positive immunological cross-reaction with the antibody of the lipase produced by the microorganism *Chromobacter viscosum* var. *lipolyticum* NRRL B-3673. This microorganism has been described in Dutch patent specification 154 269 of Toyo Jozo Kabushiki Kaisha and has been deposited with the Fermentation Research Institute, Agency of Industrial Science and Technology, Ministry of International Trade and Industry, Tokyo, Japan, and added to the permanent collection under nr. Ko Hatsu Ken Kin Ki 137 and is available to the public at the United States Department of Agriculture, Agricultural Research Service, Northern Utilization and Development Division at Peoria, Illinois, USA, under the nr. NRRL B-3673. The lipase produced by this microorganism is commercially available from Toyo Jozo Co., Tagata, Japan, hereafter referred to as "TJ lipase". These bacterial lipases of the present invention should show a positive immunological cross-reaction with the TJ lipase antibody, using the standard and well-known immunodiffusion procedure according to Ouchterlony (Acta. Med. Scan., 133, pages 76–79 {1950}).

The preparation of the antiserum is carried out as follows:

Equal volumes of 0.1 mg/ml antigen and of Freund's adjuvant (complete or incomplete) are mixed until an emulsion is obtained. Two female rabbits are injected with 2 ml samples of the emulsion according to the following scheme:

day 0 : antigen in complete Freund's adjuvant
day 4 : antigen in complete Freund's adjuvant
day 32 : antigen in incomplete Freund's adjuvant
day 60 : booster of antigen in incomplete Freund's adjuvant The serum containing the required antibody is prepared by centrifugation of clotted blood, taken on day 67.

The titre of the anti-TJ-lipase antiserum is determined by the inspection of precipitation of serial dilutions of antigen and antiserum according to the Ouchterlony procedure. A $2^5$ dilution of antiserum was the dilution that still gave a visible precipitation with an antigen concentration of 0.1 mg/ml.

All bacterial lipases showing a positive immunological cross-reaction with the TJ-lipase antibody as hereabove described are lipases suitable in the present invention. Typical examples thereof are the lipase ex *Pseudomonas fluorescens* IAM 1057 available from Amano Pharmaceutical Co., Nagoya, Japan, under the tradename Amano-P lipase, the lipase ex *Pseudomonas fragi* FERM P 1339 (available under the trade-name Amano-B), the lipase ex *Pseudomonas nitroreducens* var. *lipolyticum* FERM P 1338, the lipase ex *Pseudomonas sp.* available under the trade-name Amano CES, the lipase ex *Pseudomonas cepacia,* lipases ex *Chrombacter viscosum,* e.g. *Chrombacter viscosum* var. *lipolyticum* NRRL B-3673, commercially available from Toyo Jozo Co., Tagata, Japan; and further *Chrombacter viscosum* lipases from U.S. Biochemical Corp. USA and Diosynth Co., The Netherlands, and lipases ex *Pseudomonas gladioli.*

An example of a fungal lipase as defined above is the lipase ex *Humicola lanuginosa,* available from Amano under the trade-name Amano CE; the lipase ex *Humicola lanuginosa* as described in the aforesaid European Patent Application 0258,068 (NOVO), as well as the lipase obtained by cloning the gene from *Humicola lanuginosa* and expressing this gene in *Aspergillus oryzae,* commercially available from NOVO Industri A/S under the trade name "Lipolase". This lipolase is a preferred lipase for use in the present invention.

The lipases of the present invention are included in the liquid detergent composition in such an amount that the final composition has a lipolytic enzyme activity of from 100 to 0.005 LU/mg, preferably 25 to 0.05 LU/mg of the composition.

A Lipase Unit (LU) is that amount of lipase which produces 1 μmol of titratable fatty acid per minute in a pH stat. under the following conditions: temperature 30° C.; pH =9.0; substrate is an emulsion of 3.3 wt.% of olive oil and 3.3% gum arabic, in the presence of 13 mmol/l $Ca^{2+}$and 20 mmol/l NaCl in 5 mmol/l Tris-buffer.

Naturally, mixtures of the above lipases can be used. The lipases can be used in their non-purified form or in a purified form, e.g. purified with the aid of well-known absorption methods, such as phenyl sepharose absorption techniques.

Preferably, the compositions of the invention also comprise a proteolytic enzyme. Indeed, it has been found that one of the benefits found for the polymers of the present invention is that they ca stabilize lipase towards degradation by protease. The proteolytic enzyme, used in the present invention, can be of vegetable, animal or microorganism origin. Preferably, it is of the latter origin, which includes yeasts, fungi, molds and bacteria. Particularly preferred are bacterial subtilisin type proteases, obtained from e.g. particular strains of B. subtilis and B. licheniformis. Examples of suitable commercially available proteases are Alcalase, Savinase, Esperase, all of NOVO Industri a/S; Maxatase and Maxacal of Gist-Brocades; Kazusase of Showa Denko; BPN and BPN' proteases and so on. The amount of proteolytic enzyme, included in the composition, ranges from 0.1-50 GU/mg, based on the final composition. Naturally, mixtures of different proteolytic enzymes may be used.

A GU is a glycine unit, which is the amount of proteolytic enzyme which under standard incubation conditions produces an amount of terminal $NH_2$ -groups equivalent to 1 microgramme/ml of glycine.

The compositions of the invention furthermore comprise one or more detergent-active materials such as soaps, synthetic anionic, nonionic, amphoteric or zwitterionic detergent materials or mixtures thereof. These materials are all well-known in the art. Preferably, the compositions contain a nonionic detergent or a mixture of a nonionic and an anionic detergent. Nonionic detergents are well-known in the art. They are normally reaction products of compounds having a hydrophobic group and a reactive hydrogen atom, for example, aliphatic alcohols, acids, amides or alkylphenols with alkylene oxides, especially ethylene oxide either alone or with propylene oxide. Typical examples of suitable nonionic detergents are alkyl ($C_6$–$C_{12}$) phenol-ethylene oxide condensation products with generally 5-25 moles of ethylene oxide per mole of alkylphenol, the condensation products of aliphatic $C_8$–$C_{18}$ primary or secondary, linear or branched chain alcohols with generally 5-40 moles of ethylene oxide, and products made by condensation of ethylene oxide and propylene oxide with ethylenediamine. Other nonionic detergents include the block copolymers of ethylene oxide and propylene oxide, alkylpolyglycosides, tertiary amine-oxides and dialkylsulphoxides. The condensation products of the alcohols with ethylene oxide are the preferred nonionic detergents.

Anionic detergents, suitable for inclusion in the compositions of the present invention include the $C_{10}$–$C_{24}$ alkylbenzenesulphonates, the $C_{10}$–$C_{18}$ alkanesulphonates, the $C_{10}$–$C_{24}$ alkylethersulphates with 1-10 moles of ethylene and/or propyleneoxide in the ether variety and so on.

In general, the compositions may contain the detergent-active compounds in an amount of 5-70% by weight.

The liquid detergent compositions of the present invention can furthermore contain one or more other, optional ingredients. Such optional ingredients are e.g. perfumes, including deoperfumes, colouring materials, opacifiers, soil-suspending agents, soil-release agents, solvents such as ethanol, ethyleneglycol, propylene glycol, hydrotropes such as sodium cumene, toluene- and xylenesulphonate as well as urea, alkaline materials such as mono-, di- or triethanol-amine, clays, fabric-softening agents and so on. The liquid detergent composition may be unbuilt or built. If a built liquid detergent composition is required, the composition may contain from 1-60%, preferably 5-30% by weight of one or more organic and/or inorganic builder. Typical examples of such builders are the alkalimetal ortho-, pyro- and tri- polyphosphates, alkalimetal carbonates, either alone or in admixture with calcite, alkalimetal citrates, alkalimetal nitrilotriacetates, carboxymethyloxy succinates, zeolites, polyacetal carboxylates, oxydisuccinate, and other ether carboxylates and so on.

The compositions may furthermore comprise lather boosters, foam depressors such as silicones, anti-corrosion agents, chelating agents, anti-soil redeposition agents, bleaching agents, other stabilizing agents for the enzymes such as glycerol, sodium formate, calcium salts and the like, activators for the bleaching agents and so on. They may also comprise enzymes other than the proteases and lipases, such as amylases, oxidases and cellulases. In general, the compositions may comprise such other enzymes in an amount of 0.01-10% by weight.

The balance of the formulation will be an aqueous medium.

The invention will further be illustrated by way of Examples.

EXAMPLE I

The stability of Lipolase in the formulation given below was determined by measuring the lipase activity, using the pH-stat method as a function of time of storage at 37° C. The half-life time was determined by plotting ln [Ao/At] vs. time, where A0=initial activity and At=activity at time t, and performing a linear regression. The formulation was as follows:

| | composition (wt %) | |
|---|---|---|
| | 1.1 | 1.2 |
| sodium linear dodecylbenzene sulphonate | 10.0 | 10.0 |
| $C_{12}$–$C_{15}$ linear primary alcohol, condensed with 9 moles of ethylene oxide | 8.0 | 8.0 |
| sodium salt of sulphated $C_{12}$–$C_{15}$ linear primary alcohol, condensed with 3 moles of ethylene oxide | 6.0 | 6.0 |
| sodium xylenesulphonate | 3.0 | 3.0 |
| citric acid | 7.0 | 7.0 |
| borax | 2.7 | 2.7 |
| triethanolamine | 2.0 | 2.0 |
| monoethanolamine | 2.0 | 2.0 |
| stearic acid | 0.08 | 0.08 |
| sodium hydroxide | to neutralize to pH = 7 | |
| Lipolase | 3.0 | 3.0 |
| water | to 100% | to 100% |
| polymer* | 2.0 | — |

*The polymer was a polyester of adipic acid and ethyleneglycol with pendant fatty amine chains, available from Hoechst under the code PE/88/2W having a molecular weight believed to be about 22,000 and having the structure:

$$-[CO(CH_2)_4CO]_y-[OCH_2CH_2]_x-\underset{\underset{R}{|}}{N}-[CH_2CH_2O]_z$$

where y is 25, x + z is 50 and $\frac{x+z}{y}$ is 2, and R is a $C_{16}$–$C_{18}$ hydrocarbon.

The half-life time of the Lipolase was 17.0 days in 1.1, and 12.2 days in 1.2.

EXAMPLE II

The following formations were prepared and evaluated for lipase activity at 37° C. as in Example I.

| | composition (wt. %) | | |
|---|---|---|---|
| | 2.1 | 2.2 | 2.3 |
| $C_{12}$–$C_{15}$ linear primary alcohol, condensed with 9 moles of ethylene oxide | 16.5 | 16.5 | 16.5 |
| sodium $C_{11}$ - alkylbenzene sulphonate | 3.5 | 3.5 | 3.5 |
| ethanol | 5.0 | 5.0 | 5.0 |
| sodium formate | 2.7 | 2.7 | 2.7 |
| Alcalase 2.5 L (protease ex NOVO) | 0.75 | 0.75 | 0.75 |
| Lipolase | 3.0 | 3.0 | 3.0 |
| water | to 100% | to 100% | to 100% |
| polymer* | — | 2.0 | — |
| polymer** | — | — | 1.0 |

*this polymer was the same as in Example I.

**this polymer was a copolymer of ethyleneglycol and terephthalic acid as described in U.S. Pat. No. 3,959,230, having a molecular weight of about 20,000 and the structure:

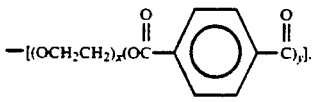

where x is 220 and y is 10, available under the trade name Alkaril QCJ.

The half-life time of Lipolase in these formulations was: 1.7 days in 2.1; 8.8 days in 2.2 and 5.0 days in 2.3.

EXAMPLE III

The following compositions were prepared and evaluated for lipase stability at 37° C.

| | composition (wt %) | |
|---|---|---|
| | 3.1 | 3.2 |
| $C_{12}$–$C_{15}$ linear primary alcohol, condensed with 9 moles of ethylene oxide | 16.5 | 16.5 |
| ethanol | 4.9 | 4.9 |
| sodium formate | 2.7 | 2.7 |
| Savinase (a protease ex NOVO) | 0.375 | 0.375 |
| Lipolase | 3.0 | 3.0 |
| polymer* | — | 1.0 |
| water | to 100% | to 100% |
| The half life time of Lipolase was (at 37° C.): | 16.0 | 47.7 |

*The polymer was a copolymer of ethyleneglycol with pendant vinylacetate side chains having a molecular weight of about 24,000 as described in European Patent 219,048. The polymer is available from BASF under the code HP22 and has the structure:

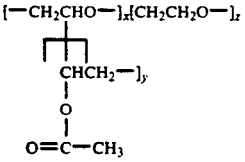

where y is about 56; x + z is about 392 and $\frac{x+z}{y}$ is 7.

EXAMPLE IV

Preparation of Polymers

The polymers were prepared according to the procedure described in GB 922,457. Briefly, the procedure involves melting the PEG under nitrogen at 80° C., adding the vinyl monomer and benzoyl peroxide initiator and polymerizing for two hours at 80° C. and one hour at 90° C. The resulting graft copolymer is dispersed in water and supplied as a 15 wt.% dispersion.

Enzyme Stability

The lipase stabilizing properties of polymers prepared in the above manner was evaluated in the following liquid detergent composition:

| Ingredient | wt. % |
|---|---|
| Sodium $C_{11}$ Alkyl Benzene Sulfonate | 3.5 |
| $C_{12}$–$C_{15}$ linear primary alcohol, condensed with 9 moles of ethylene oxide | 16.5 |
| Ethanol | 5.0 |
| Sodium Formate | 2.7 |
| Alcalase 2.5 L | 0.75 |
| Lipolase | 3.0 |
| polymer (from Table 1) | 1.0 |
| sodium hydroxide | to pH = 7 |
| water | to 100% |

Enzyme Stability

Half-life times of lipolase in the compositions were determined by measuring the enzyme activity as a function of time of storage at 37° C., plotting ln ($A_O/A_t$) versus time and performing a linear regression (where $A_O$=initial activity and $A_t$=activity of time =t). A description of the polymers and the results are presented below:

TABLE 1

| PEG MW | vinyl monomer | PEG/ monomer | $t_{\frac{1}{2}}$ (days) | comments |
|---|---|---|---|---|
| — | — | — | 4.0 | control |
| 20,000 | vinyl acetate | 7/1 | 6-7 | BASF HP-22 |
| 20,000 | vinyl acetate | 5/1 | 6.5 | BASF 2240/12 |
| 20,000 | vinyl acetate | 4/1 | 7.0 | BASF 2240/13 |
| 1,000 | methyl methacrylate | 7/1 | 7.4 | |
| 1,450 | methyl methacrylate | 7/1 | 6.5 | |
| 1,450 | styrene | 7/1 | 5.2 | |
| 1,450 | butyl acrylate | 7/1 | 7.1 | |

The results demonstrate that the PEG/vinyl monomer graft copolymers, even if somewhat insoluble or dispersible, improve lipolase stability in an alcalase containing HDL. Especially preferred are vinyl esters such as vinyl acetate, methyl methacrylate, and butyl acrylate.

EXAMPLE V

A series of representative water soluble polymers that are not copolymers of ethylene glycol were evaluated. The liquid detergent composition of this example was identical with that of Example II. Each of the polymers was tested at 2.0% in this composition for improving lipase stability. The results are presented below.

| Ingredients | Composition (wt. %) | | | | |
|---|---|---|---|---|---|
| | 4.1 | 4.2 | 4.3 | 4.4 | 4.5 |
| Formulation of Example 2.1 | 100.0 | 98.0 | 98.0 | 98.0 | 98.0 |
| Polymer LR 400 ex Amerchol | 0.0 | 2.0 | 0.0 | 0.0 | 0.0 |
| Carteretin F4 ex Sandoz | 0.0 | 0.0 | 2.0 | 0.0 | 0.0 |
| Poly(vinyl alcohol) ex Gohsenol GH-20 | 0.0 | 0.0 | 0.0 | 2.0 | 0.0 |
| Poly(vinyl pyridine N-oxide) ex Polyscience | 0.0 | 0.0 | 0.0 | 0.0 | 2.0 |
| stability(at 37° C.): $t_{\frac{1}{2}}$ (days) | 1.7 | 1.3 | 1.6 | 1.5 | 1.8 |

Polymer LR 400 is an example of a cationic cellulose polymer that was shown in U.S. Pat. No. 4,011,169 to provide improved enzyme stability in buffer solutions, but was found to be ineffective when incorporated into a liquid detergent. Carteretin F4 is a copolymer of adipic acid and dimethyl amino hydroxy propyl diethylene triamine of the following structure:

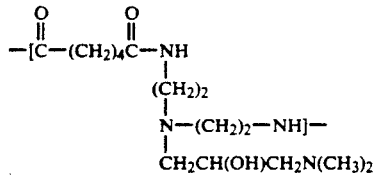

Carteretin F4 was found to have no effect on lipase stability at a concentration of 2.0 wt. %. Poly(vinyl alcohol) had no effect on lipase stability. Poly(vinyl pyridine-N-oxide), was found to have no effect on lipase stability.

EXAMPLE VI

A series of nonionic compolymers of polyvinylpyrrolidone (PVP) with vinyl acetate (VA) or vinyl imidazoline (VI) were evaluted for lipase stabilizing properties. The detergent liquid composition was identical with that of Example II, 2.1 Each of the polymers was tested at 2.0% in this composition. The results are presented below:

| Ingredient | | Composition (wt. %) | | | |
|---|---|---|---|---|---|
| | | 5.1 | 5.2 | 5.3 | 5.4 |
| Formulation of Example 2.1 | | 100.0 | 98.0 | 98.0 | 98.0 |
| PVP/VI = | 10/90 | 0.0 | 2.0 | 0.0 | 0.0 |
| | 50/50 | 0.0 | 0.0 | 2.0 | 0.0 |
| | 30/70 | 0.0 | 0.0 | 0.0 | 2.0 |
| Stability $T_{\frac{1}{2}}$ (days) | | 2.2 | 2.6 | 3.2 | 2.6 |

| Ingredient | | Composition (wt. %) | | | | |
|---|---|---|---|---|---|---|
| | | 5.5 | 5.6 | 5.7 | 5.8 | 5.9 |
| Formulation of Example 2.1 | | 98.0 | 98.0 | 98.0 | 98.0 | 98.0 |
| PVP/VA = | 100/0 | 2.0 | 0.0 | 0.0 | 0.0 | 0.0 |
| | 70/30 | 0.0 | 2.0 | 0.0 | 0.0 | 0.0 |
| | 60/40 | 0.0 | 0.0 | 2.0 | 0.0 | 0.0 |
| | 50/50 | 0.0 | 0.0 | 0.0 | 2.0 | 0.0 |
| | 30/70 | 0.0 | 0.0 | 0.0 | 0.0 | 2.0 |
| Stability: $t_{\frac{1}{2}}$ (days) | | 2.3 | 3.2 | 3.1 | 2.8 | 2.7 |

None of the copolymers of either series was effective at stabilizing lipase in this composition.

What is claimed is:

1. An enzymatic liquid detergent composition comprising, in an aqueous liquid medium, from 0.005-10-0LU per milligramme of the final composition of a lipolytic enzyme selected from *Humicola Lanuginosa* and *Thermomyces lanuginosus* and bacterial lipases which show a positive immunological cross-reaction with the antibody of the lipase, produced by Chrombacter viscosum var. lipolyticum NRRL B-3673, about 5% to about 70% by weight of a detergent-active compound, and about 0.1% to about 10% by weight of an ethylene glycol containing polymer with an average molecular weight of 3,000 to 1,000,000 having the following structure:

where R' is a saturated, unsaturated, or aromatic hydrocarbon of 2-18 carbon atoms, R'' is selected from the group consisting of propylene glycol, butylene glycol, fatty amine ethoxylate, polyethylene glycol ether of glycerol esters and fatty ethanolamides, Q and L are independently selected from the group consisting of:

i) hydrogen, alkyl, alkylaryl, alkoxy, alkylamine groups containing 1 to 20 carbon atoms, and ii) vinyl monomers selected from the group consisting of vinyl esters, acrylamides, styrenes and mixtures thereof where m has a value of at least one and n and p are any integer including zero, except n and p cannot be O when L is hydrogen, said polymer being soluble or dispersible in said liquid detergent composition.

2. The composition of claim 1 wherein said vinyl monomers are selected from the group of vinyl esters.

3. The composition of claim 1 wherein said vinyl monomers are selected from the group consisting of methyl methacrylate, butyl acrylate, styrene, and acrylamide and mixtures thereof.

4. An enzymatic liquid detergent composition comprising, in an aqueous liquid medium, from 0.005-10-0LU per milligramme of the final composition of a lipolytic enzyme selected from *Humicola Lanuginosa* and *Thermomyces lanuginosus* and bacterial lipases which show a positive immunological cross-reaction with the antibody of the lipase, produced by Chrombacter viscosum var. lipolyticum NRRL B-3673, about 5% to about 70% by weight of detergent-active compound, and about 0.1% to about 10% by weight of a copolymer of adipic acid and ethylene glycol substituted with alkyl amine having the following structure:

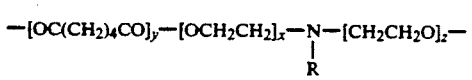

where R is $C_{16}$–$C_{18}$ hydrocarbon, wherein y is about 1 to about 500; where the value of the sum of x+z is about 40 to about 14,000 and wherein the value of the fraction $$\frac{x+z}{y}$$

is about 2 to about 5.

5. An enzymatic liquid detergent as defined in claim 4 wherein y is about b 25, the sum of x+y is about 50 and $$\frac{x+z}{y}$$

is about 2.

6. An enzymatic liquid detergent composition comprising, in an aqueous liquid medium, from 0.005–10-0LU per milligramme of the final composition of a lipolytic enzyme selected from *Humicola Lanuginosa* and *Thermomyces lanuginosus* and bacterial lipases which show a positive immunological cross-section with the antibody of the lipase, produced by Chrombacter viscosum var. lipolyticum NRRL B-3673, about 5% to about 70% by weight of a detergent-active compound, and about 0.1% to about 10% by weight of a copolymer of ethylene glycol with pendant vinyl acetate side chains having the structure:

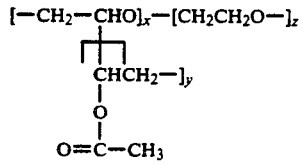

wherein y is about 50; wherein x+z is about 400 and wherein the value of the fraction $$\frac{x+z}{y}$$

is about 7.

7. A detergent composition as defined in claim 1 wherein said vinyl esters are selected from the group consisting of vinyl acetate, methyl methacrylate, butyl acrylate and mixtures thereof.

* * * * *

UNITED STATES PATENT AND TRADEMARK OFFICE

CERTIFICATE OF CORRECTION

PATENT NO. : 5,082,585

DATED : January 21, 1992

INVENTOR(S) : Hessel,et al

It is certified that error appears in the above-identified patent and that said Letters Patent is hereby corrected as shown below:

Col. 10, line 27-28, 66-67, Col. 11 and 12, line 32 & 1, claim 1, 4, and 6 wherein "0.005-10-OLU" appears, it should have read --0.005-100 LU --.

Col. 11, line 2, (claim 5) remove the letter b from the phrase "about b 25" to read -- about 25 --.

Signed and Sealed this

Twentieth Day of April, 1993

*Attest:*

MICHAEL K. KIRK

*Attesting Officer*

*Acting Commissioner of Patents and Trademarks*